United States Patent [19]

Massimo et al.

[11] Patent Number: 4,548,031

[45] Date of Patent: Oct. 22, 1985

[54] MACHINE FOR PRODUCING ORNAMENTAL CHAINS MADE UP OF LINKS OF DIFFERENT FORMS AND/OR DIMENSIONS CONNECTED IN ANY PROGRAMMABLE SEQUENCE

[75] Inventors: Bucefari Massimo; Lazzarini Michele, both of Arezzo, Italy

[73] Assignee: I.C.M. S.p.A. Italiana Costruzioni Metalmeccaniche, Arezzo, Italy

[21] Appl. No.: 508,262

[22] Filed: Jun. 27, 1983

[30] Foreign Application Priority Data

Jul. 7, 1982 [IT] Italy ..... 9460 A/82

[51] Int. Cl.[4] ..... B21L 7/00

[52] U.S. Cl. ..... 59/16; 59/7; 59/18; 59/24

[58] Field of Search ..... 59/1, 3, 7, 16, 17, 59/18, 20, 22, 23, 24, 25; 82/27, 25 R

[56] References Cited

U.S. PATENT DOCUMENTS

| | | | |
|---|---|---|---|
| 1,340,639 | 5/1920 | Weinacker | 59/25 |
| 1,761,415 | 6/1930 | Speidel et al. | 59/16 |
| 3,023,631 | 3/1962 | Curtis | 82/27 |
| 3,643,532 | 2/1972 | Moss | 82/27 |
| 4,127,987 | 12/1978 | Tega et al. | 59/16 |
| 4,275,555 | 6/1981 | Bichi | 59/18 |
| 4,311,003 | 1/1982 | Tega | 59/16 |

FOREIGN PATENT DOCUMENTS

| | | | |
|---|---|---|---|
| 2804310 | 8/1978 | Fed. Rep. of Germany | 59/16 |

*Primary Examiner*—Daniel C. Crane
*Assistant Examiner*—David B. Jones
*Attorney, Agent, or Firm*—Browdy and Neimark

[57] ABSTRACT

A machine for the production of decorative chains made up of links of different forms and/or dimensions connected according to any programmable sequence, comprising at least two independent formation stations (1, 1') in alternate operation according to a prefixed, alterable program on the basis of the features of the chain to be manufactured, and a take-up unit (14), for transferring the chain from one station to another according to said program. Drive means for said take-up unit (14) are provided in each station for actuating the opening and closure of pliers (27), carried by said unit (14) during chain take-up and delivery phases, for producing an axial movement of said unit (14) to and from said stations in coincidence with said phases and for producing an angular displacement of said unit (14) with respect to its axis during said phases. Finally, said drive means enable the station to release the last formed link to said take-up unit (14).

14 Claims, 9 Drawing Figures

FIG.7
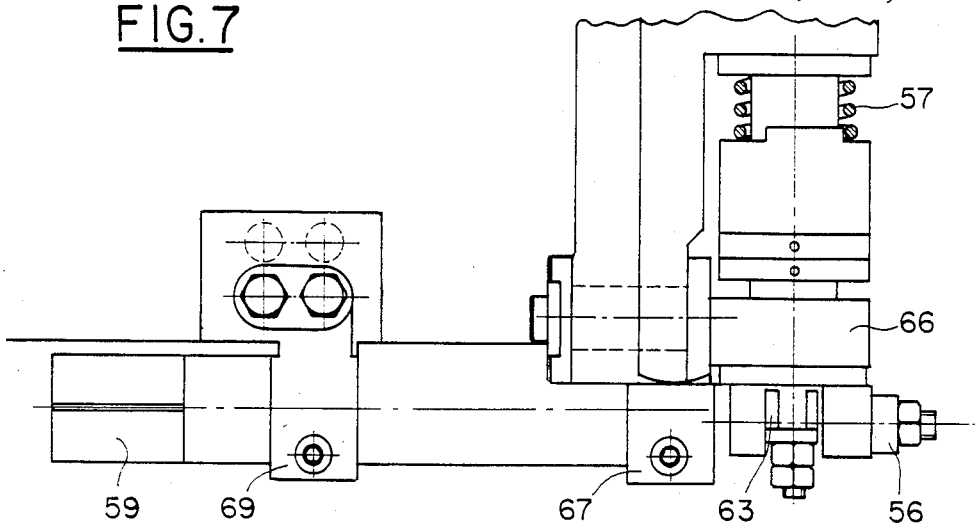
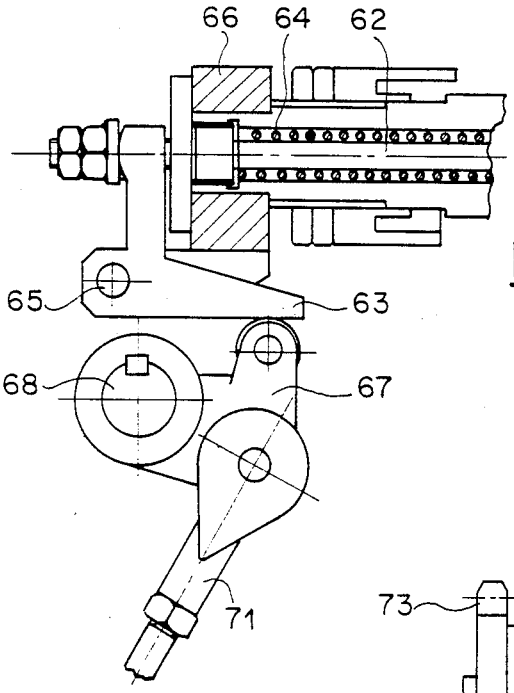
FIG.6
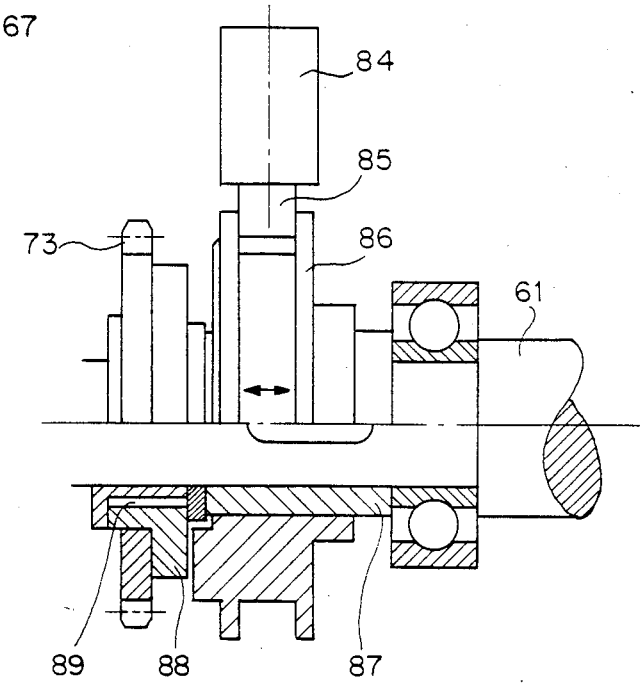
FIG.8

MACHINE FOR PRODUCING ORNAMENTAL CHAINS MADE UP OF LINKS OF DIFFERENT FORMS AND/OR DIMENSIONS CONNECTED IN ANY PROGRAMMABLE SEQUENCE

The present invention relates to the field of machines for the goldsmithery industry. More in particular, the object of the invention is a machine for producing ornamental chains made up of links of different forms and/or dimensions connected in any programmable sequence.

For producing some kinds of chains of the type mentioned above, indicated generically as "alternate-link chains", there are presently used machines consisting essentially of two stations for the formation of two different types of links alternately in operation and generally of mobile pliers which move between the two stations and participate directly in the formation of the links and the making of the chain and in the transfer of the chain being made from one station to the other at the end of each cycle of operation. In order to obtain the motion of translation of the pliers between one working position and another in the two stations, they are integrally connected to the movable extremity of an oscillating lever which is temporarily made to cooperate, according to a preset, alterable program, with cams so profiled as to cause selective displacement of the lever in one or the other direction. A motor, common for both station, is provided for driving the various organs they comprise; adequate mechanical couplings, made operational in correspondence to the travel end of the pliers allow for the transmission of the drive force to one of the stations while excluding the other. A machine of the type described above is described in detail in U.S. Pat. No. 4,175,379. Other models of known machines for the production of alternate-link chains provide separate drive mechanisms for each of the two stations.

This type of machine and other, analogous types on the market, impose considerable limits on production, due to their very structure. In fact, if it is possible to produce chains made up of two different types of links, of different dimensions but of the same form (for example flat link or "cable chain" or twisted link or "curb chain") with these machines, it is not on the other hand possible to produce a chain in which a twisted link is linked to a flat one, since the common pliers unit of the machine cannot be so regulated as to allow for two different positions of rotation of its pliers-holder shaft around its own axis; that is, for the types of rotation characteristic of the formation of the flat and of the twisted types of links. In fact, in the case of the twisted link, the shaft assumes a position in which the last link formed lies on a vertical plane, while in the case of the flat link the shaft assumes a position in which the last link formed lies on a horizontal plane. In known machines each station is provided with controls for the rotation of the mobile pliers, composed of cams and rocker arms with heads that can be substituted, according to a traditional technique in the art, depending upon the type of chain to be produced in each station. The movable pliers, once disengaged from the rocker arm responsible for the rotation of its shaft by means of a rack assumes always the same position which is maintained even during the transfer from one station to the other. Said positioning is obtained in the known manner with a stop register on the extremity of the rack opposite to that engaged, in the one and the other of the two stations, with the rocker arm which effectuates the rotation of the pliers, for which reason in the return phase operated by an opposing spring the rack always ends its stroke against the register, positioning the pliers always in the same manner for the linking phase. If, for example, a machine of this type should have to execute an operative cycle in which links of the twisted type produced in the first station, for example that on the left, must be linked to flat links produced in the second, that on the right, the pliers in the first station would position each link formed in a vertical attitude; once completed the number of links to be formed, the pliers stop with the rack against the register and the link positioned as indicated above. Subsequently the pliers move to the second station for linking with the link in the same position with respect to the coil of wire which now comes from the right. At this point the link is engaged with the wire and left free; then the same pliers pick up the coil that has been attached to the link in order to form a new link which will be of the flat type. When the predetermined number of flat links have been made, the pliers, disengaged from the rocker arm, move toward the first station, presenting the last-made link in the same vertical position, a position which at this point and having been assumed by a flat link, does not consent linking, as said link is on a plane which is substantially orthagonal to that of the axis of the coil and which therefore cannot link up with the wire of the spiral. For these reasons a machine as described above cannot produce chains composed at the same time of both flat and twisted links, since it would have to be provided with means for changing the position of the pliers when delivering the first link only at each single station, means which present considerable problems at both the design and structural levels with known machines.

Moreover, with the abovementioned type of machines, it is impossible to produce chains in which one link is linked to two other, following links, as is the case with the "double curb" or the "double cable", in that this presupposes the possibility of installing in each station a needle-type linking unit, which is practically impossible with said type of machine. In fact, in the case for example of the "double curb", the needle in the station where the long link is formed should have a short stroke in order to be able to move the link formed prior to the one held by the pliers and, subsequently, a longer stroke for all the other long links that have to be produced in that station. To this end in that station one would have to provide a programmed control for the needle, to be made operative during the phase of linking of the first link: this is obviously impossible because the machine has a single camshaft in each station, which rotates continually when it produces the links.

Another important limitation of known machines is the fact that they cannot produce chains formed of more than two different types of links, because the mobile pliers cannot be made to work in cooperation with more than two stations nor, even if in substance they dispose of two production stations, can these machines make the two stations work independently and in parallel in order to produce two chains, since the pliers unit is common to the two stations and thus, if it is working with one, the other must necessarily remain idle.

Another, and not negligible, inconvenience of the known machines consists in their high noise level, which derives from the continual intervention of the mechanical clutchs connecting the motor first to one then to the other station. This drawback requires the adoption of special and costly devices to minimize its consequences.

The main object of the present invention is to provide a machine for producing ornamental chains characterized by any predetermined alternating order of two or more types of links of different forms and/or dimensions, linked up in sequences, for example, formed by single links of different types, alternated, or by more than one link of one type, alternated with more than one link of other types in lengths that may be fixed or variable, if desired, according to a predetermined progression, for example in diminishing order.

Another object of this invention is to provide a machine for the production of alternate-link chains which, if necessary, can also be used for the simultaneous production of more than one chain, of the same or different type, in number equal to the number of stations with which the machine is furnished, which must therefore be made to work in parallel and autonomously.

Another object of this invention is to provide a machine of the type mentioned above which can be fitted with needle linking devices in order to consent the production of "double curb" or "double cable" type chains.

One further object of the invention is to provide a machine for the production of alternate-link chains which, without in any way compromising good operation or efficiency in production and without taking any special precautions, maintains a noise level within limits decisively lower than the maximum permitted with a considerable benefit to the operators.

The fundamental characteristic of the machine for producing alternate-link chains according to the present invention is the fact that it is made up of two or more independent operative stations, that is, each complete in and of itself and equipped with its own drive means, and of a take-up unit which tranfers the chain being made from one station to another. The take-up unit is integral with a mobile equipment, driven by its own motor, which executes an alternating, intermittent movement, the frequency of which is controlled by a predetermined program which may be modified according to the type of chain one wishes to produce. The take-up unit, which does not participate, in the various stations, in the operations necessary for the formation of the link and the linking-up of the chain, picks up the last link made in one station and linked to the previously-formed part of the chain and delivers it to the next station wherein the making of the chain continues from this last link, but with links of different types or shape.

Independent drive means are provided for the take-up unit, in particular of the type composed of cams and relative rocker arms which control the opening and the closing of the pliers in the phase of take-up of the last link of the chain in one station and in the phase of delivery to another, and which moreover give it an axial motion from and toward the working planes of said stations, in correspondence to the abovementioned phases. Said drive means moreover, preset the working station, at the beginning and at the end of every operative cycle, for the take-up and, respectively, for the letting-go of the last link of the already-formed part of the chain, which will be correspondingly delivered or picked up by the take-up unit. In particular, said drive means impart small angular movements to the take-up unit in correspondence with the abovementioned phases of take-up and delivery of the link. The intervention of said drive means is limited to the phase which immediately precedes the beginning of an operative cycle in a station, when the take-up unit delivers to it the chain taken up from another station, and to the phase which immediately follows the end of the operative cycle of the station, when the same unit will have to intervene to take up the chain. Preferably, independent drive means will be provided for each station, for the movement of the mobile equipment which carries the take-up unit, and for driving this last in each of the stations.

Other characteristics, as well as advantages, of the machine for producing alternate-link chains according to the present invention will be clearer from the following description of one embodiment thereof as an example and in no way limitating, made with reference to the attached drawings, in which:

FIG. 6 shows a partial section along the line VI—VI of FIG. 5.

FIG. 7 is a partial plan view according to arrow H of FIG. 5.

FIG. 8 is an enlarged detail, in partial section, of a particular of FIG. 5.

Figure 1A:
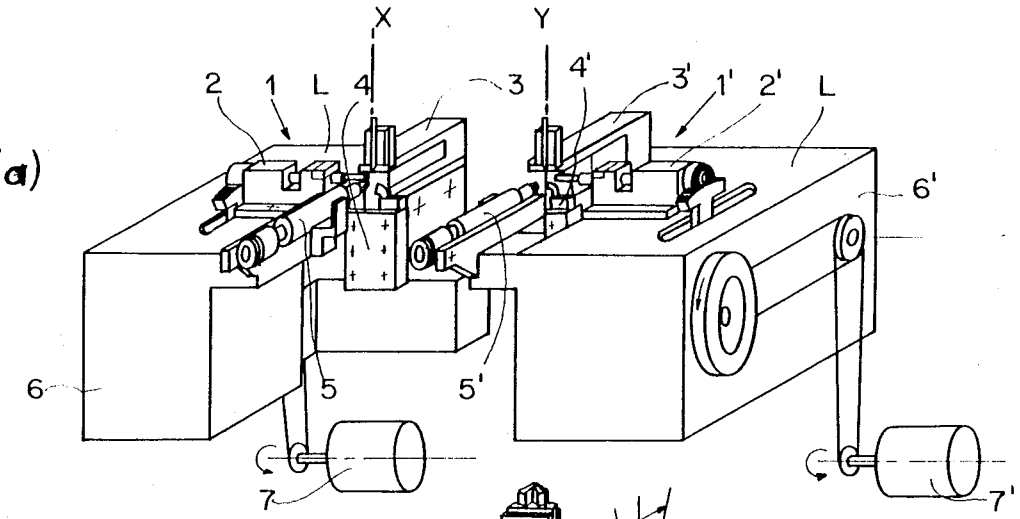
FIG. 1 shows a schematic perspective view of the stations for the formation of the chain (detail a) and, in a slightly enlarged view, the underlying take-up unit with the relative supporting structure (detail b).

With reference to FIG. 1, the machine for the production of alternate-link chains according to the present invention has been, for reasons of simplicity of description, represented exploded into two parts (details a and b), and 1 and 1' indicate generically two identical and opposed stations for the formation of ornamental chains which include the groups: 2 and 2', wire-like material feed and formation of the spiral; 3 and 3', knives for cutting a turn; 4 and 4', counter-pliers unit ("facon") for closing the link; 5 and 5', operative pliers for moving the link in the station, twisting it, and for linking. All of these units are known as concerns structure, operation, and reciprocal cooperation; their drive means are also traditional and are seated within the respective support structures 6 and 6' of the two stations, which define a common horizontal working plane L of the machine, X and Y being the working axes of the two stations at right angles to said plane. Finally, the motors 7 and 7' respectively are provided for the two stations 1 and 1'.

Figure 1B:
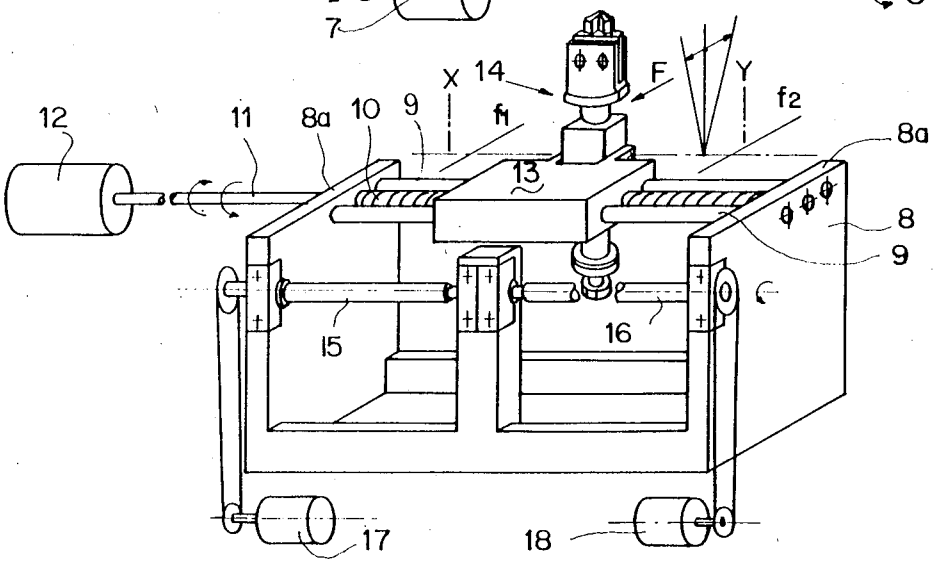

In FIG. 1*b*, 8 indicates a frame with two parallel horizontal guides 9 mounted lengthwise and a worm screw 10 parallel to the guides and in particular mounted between them and connected by means of a shaft 11 to a motor 12 which imparts a rotary movement in one direction or the other. A slide 13 is mounted for sliding on the guides 9 and is engaged with the worm screw 10, so that every rotation of the worm screw corresponds to a sliding of the slide 13 in one direction or the other between two limit stop positions indicated as f1 and f2 in the same Figure. A take-up unit indicated generally at 14 is mounted integral with the slide 13.

The frame 8 is mounted between the two stations 1 and 1' with the upper edges 8*a* of its sides set under the operative pliers unit 5 and 5', in such a manner that the plane in which the guides 9 and the worm screw 10 lie is underneath the working plane L of the machine and parallel to it, and so that in correspondence to the limit stops f1 and f2 of the slide 13, the take-up unit 14 is substantially in correspondence to the working axes X and Y of the stations 1 and 1'. FIG. 1*b* also shows two coaxial shafts 15 and 16, connected, for the transmission of motion, to the motors 17 and 18 respectively, pivotally supported by the frame 8, for driving the take-up unit 14 when it is in correspondence to the limit stops f1 and f2, as will be described further on.

Figure 2:
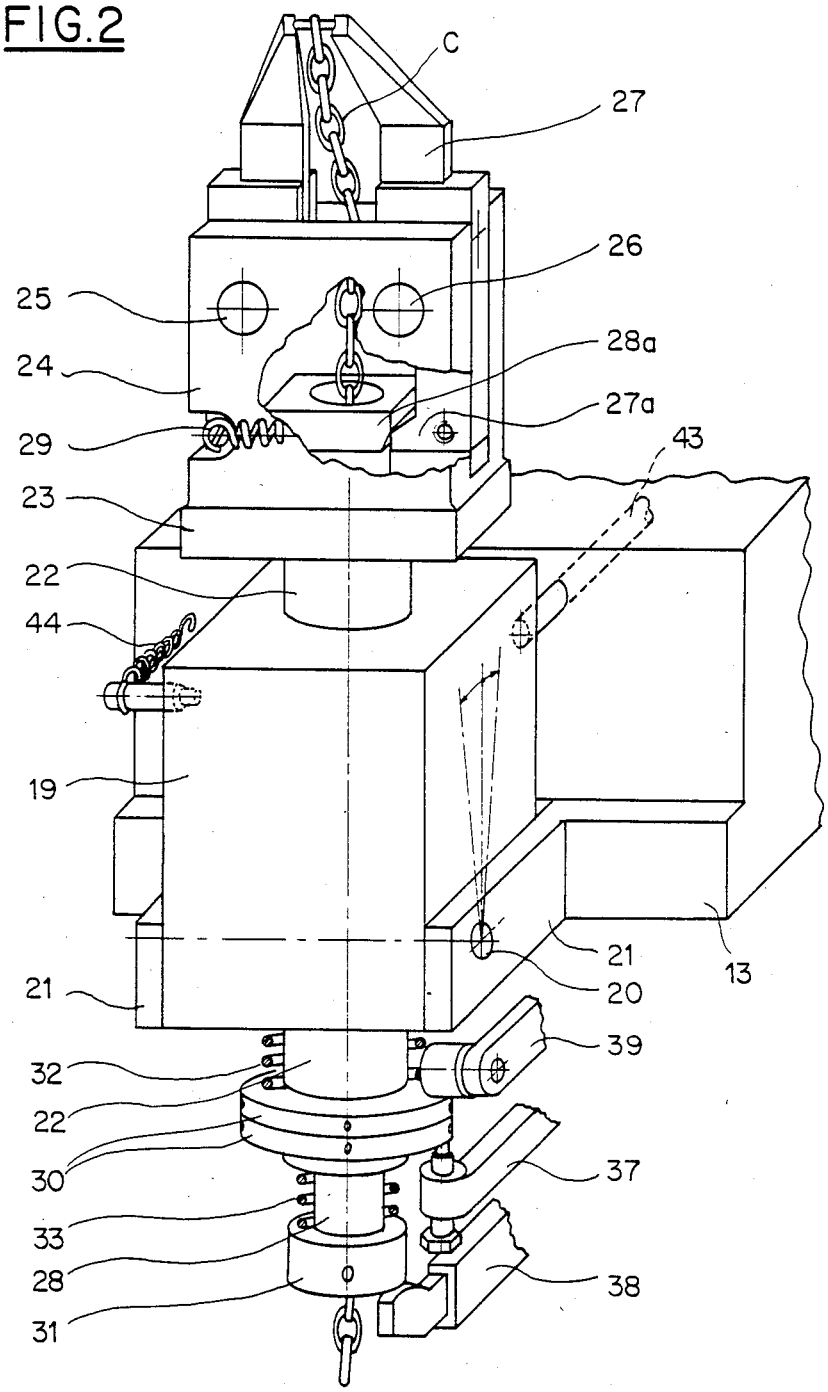
FIG. 2 shows an enlarged perspective view of the take-up unit as indicated by arrow F in FIG. 1*b*.

With reference to FIG. 2, the take-up unit 14 is formed of a base block 19 pivotally supported by two opposing pins 20 (only one is shown) to a pair of arms 21 which protrude from the slide 13. A hollow shaft 22 passes from one part to the other of said base 19 along an axis at right angles to the plane of the slide 13 and is slidable with respect to the base. At the upper end of the shaft 22, that is, the end closest to the working plane L of the machine, there is a flange 23 to which is fixed a fork 24 turned upward and carrying, on two separate pins 25 and 26, the two arms of pliers 27. Inside the hollow shaft 22 is set, coaxially and so as to slide, a tappet 28, one wedge-shaped end 28*a* of which, with a progressively increasing section, projects from the flange 23; the extremity is set between two projections 27*a* (only one shown in FIG. 2) which are opposed and at the lower extremity of the arms of pliers 27. The same extremities of the arms of the pliers 27 are connected one to the other by means of a spring 29 which is counteracting with respect to the wedge-shaped end 28*a* of the tappet 28. Tappet 28 is also hollow in the axial direction in order to provide a guide for the chain C which can in this manner be directly conveyed to a traditional-type collection station (not shown) as it is formed in the stations 1 and 1', avoiding also undesired movements of the chain during transfer from one station to the other.

At the lower end of the hollow shaft 22 and the tappet 28 there are fixed, respectively, flanges 30 and 31, on which the drive means of the take-up unit 14 act. Between the base 19 and the flange 30 of the hollow shaft 22 there is a first compression spring 32, while a second compression spring 33 is mounted between the flange 30 and the flange 31 of the tappet 28. The springs 32 and 33 operate in opposition to the drive means of the take-up unit, as will be explained further on. The operative extremities of the arms of the pliers 27 have, substantially, the form of a beak: that is, they are prolonged laterally and obliquely with respect to the axis of the unit toward the working axes X and Y of the stations 1 and 1', since, for reasons of space, the axis of the take-up unit cannot in this case be so set as to coincide with them.

Figure 3:
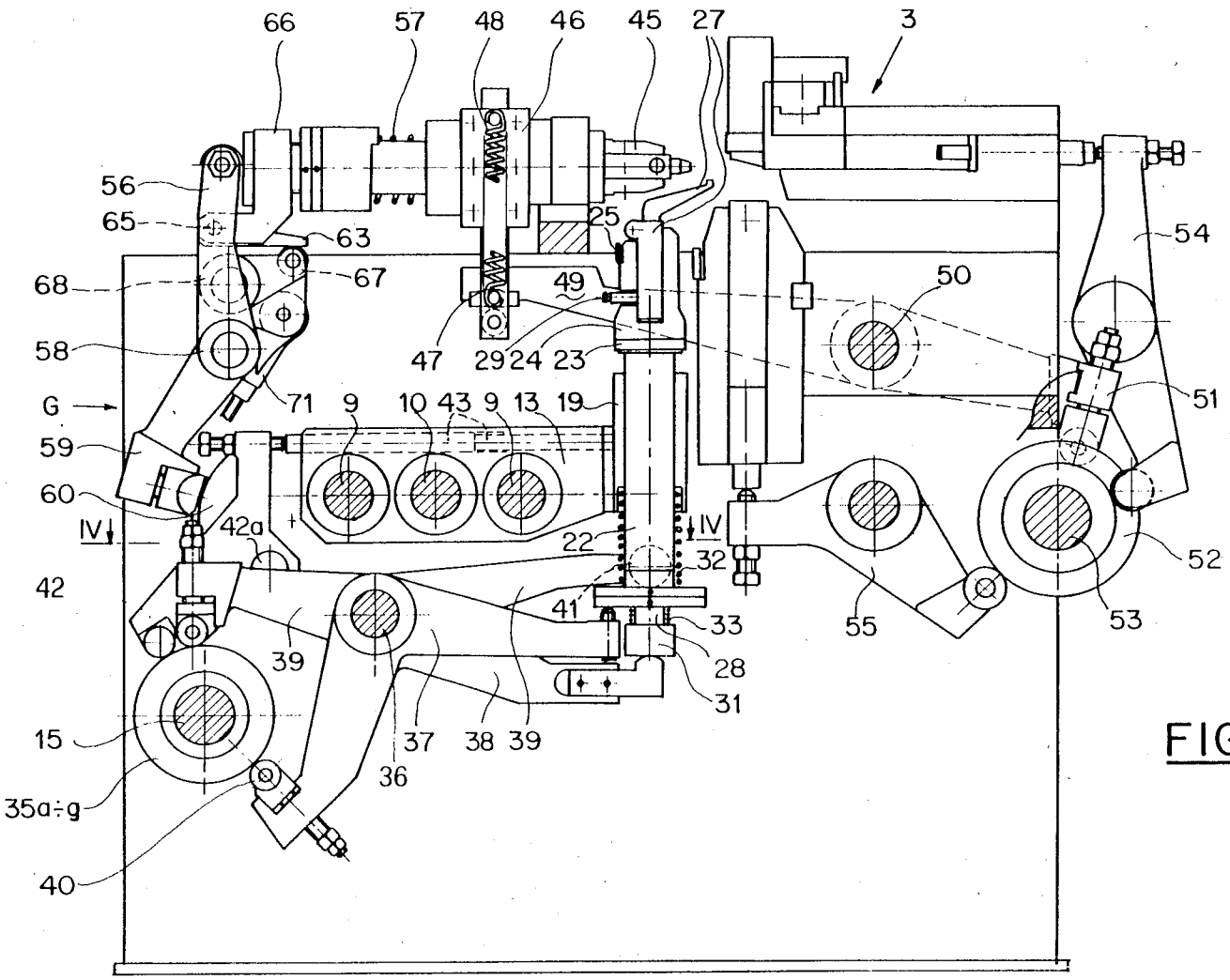
FIG. 3 represents a partial cross section of the machine along a vertical plane passing through the take-up unit while this same is in correspondence to a formation station.
Figure 4:
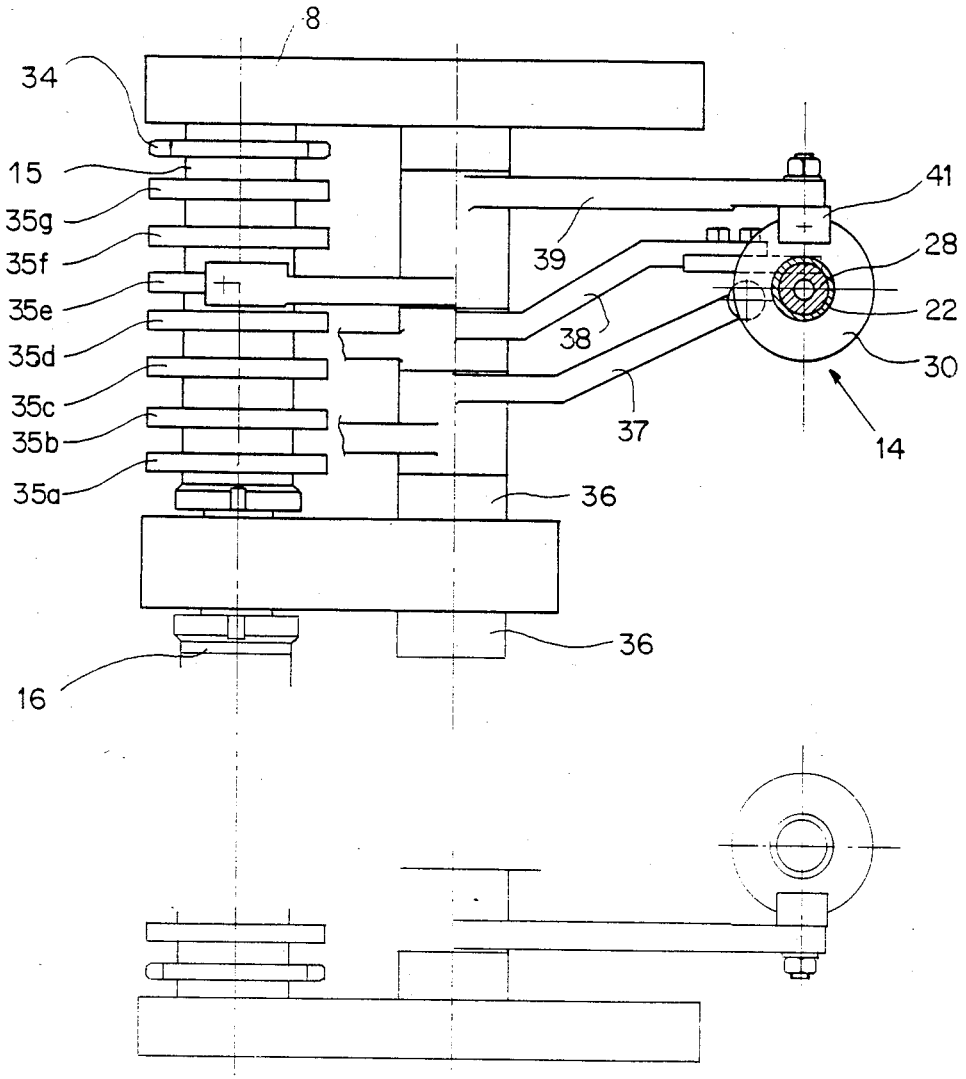
FIG. 4 shows a partial section along the line IV—IV of FIG. 3.
Figure 5:
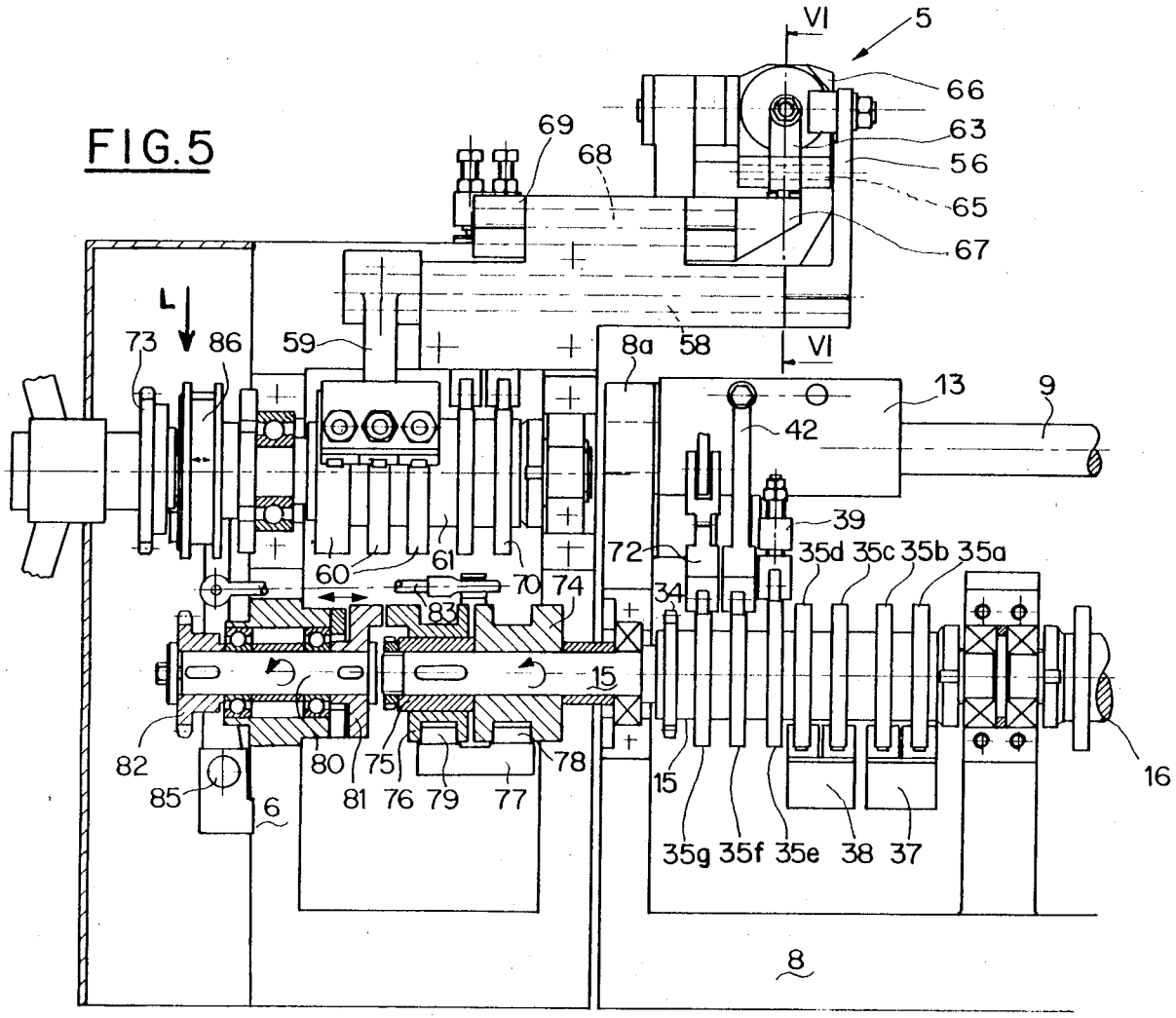
FIG. 5 is a front view, as indicated by arrow G in FIG. 3, with parts removed for simplicity, of half the machine according to the invention.

Each of the two stations 1 and 1' includes its own means for driving the take-up unit 14: these are illustrated in detail in FIGS. 3, 4, and 5. This description, for reasons of simplicity, will refer to the drive means for the station 1, which are identical to those provided for the station 1'. With particular reference to the figures cited above, on the shaft 15, which picks up its motion from its relative motor 17 (shown in FIG. 1) through a gearwheel 34, there are, keyed on, a series of cams indicated as 35*a, b, c, d, e, f, g*, which are in phase one with the others. A fulcrum 36, common to the three rocker arms indicated as 37, 38, and 39 is provided parallel to the shaft 15; the rocker arms are at one end cooperative with the cams 35*a–g*, their heads being equipped with feeler wheels 40, while at the other they act on the flanges 30 and 31 located at the end of the hollow shaft 22 and of the tappet 28 of the take-up unit 14 when this is positioned, as in the case in correspondence to the station 1. In particular, with reference to the abovementioned figures, the rocker arm levers 37 and 39, cooperative respectively with cams 35*a,b* and with cam 35*e*, act opposingly on flange 30; rocker arm . 37 controls the lift of the take-up unit 14 in opposition to the spring 32, which provokes the subsequent elastic return of the unit, while the rocker arm 39 with its own end wheel 41 works in contrast with it; that is, it is used to obtain an adjustable position of the unit at the moment when the link is taken up by operative pliers 5. The rocker arm lever 38, in its turn, cooperates with the pair of cams 35*c,d*, while with its active extremity it acts on flange 31 counteracting the spring 33 to command the axial movement of the tappet 28 upwards; in this manner the wedge-shaped end 28*a* of the tappet 28 is disengaged from the opposing projections 27*a* of the pliers 27, which, being subject to the action of the spring 29, close in thus causing the opening of the pliers 27. The cam 35*f* cooperates with a rocker arm 42, the fulcrum of which is a fixed pin 42*a* which controls the axial sliding motion of a tappet 43, in this case guided in a crosswise direction with respect to the slide 13, which acts on the base of the take-up unit 14 in order to force it to move angularly with respect to its own axis around pins 20; the action of the tappet 43 is in opposition to that of a spring 44, shown in FIG. 2, connected between the base 19 and the slide 13.

Operative pliers unit 5, even if it is substantially of the known type, is here described in order to illustrate the interconnection between its drive means and those of the take-up unit 14, an interconnection which permits the opening of operative pliers, indicated as 45 in FIG. 3, when they must transfer to pliers 27 the link held up, at the end of the operative cycle in the station. Operative pliers unit 5 can thus perform alternative angular movements on its own axis and alternating axial sliding motions. The first motion is imparted in a known manner, providing (see FIG. 3) a toothed portion 46 on the pliers unit 5 which is engaged to a rack 47, the movement of which, in one direction and the other, is provided by a spring 48 which counteracts to a lever 49, the fulcrum 50 of which is on the base structure of the machine and the head 51 cooperates with one or more cams 52 carried by a shaft 53 rotated by the motor 7 of the station. Other cams keyed to the same shaft also actuate the knives 3, by means of rocker arm 54, and the facons 4 by means of rocker arm 55. The extent of angular movement given to operative pliers unit 5 can naturally, be adapted to the necessities of production, by using, as per traditional techniques in this sector, interchangeable heads 51 for the rocker arm 49 which operate on the individual cams present on the shaft 53. The second movement of operative pliers unit 5, that is the axial sliding, is obtained (see FIGS. 3, 5, and 7) in an known manner with a lever 56 which acts on the extremity of the unit 5 in opposition to an axial spring 57. The lever 56, by means of a pin 58 fixed to the frame of the machine, is integral with a lever 59 cooperating with cam 60 which is keyed on a shaft 61 rotating together with shaft 53 by means of chain and pinion 73. For opening and closing pliers 45 (see FIG. 6), there is provided, in a known manner, a wedged rod 62 sliding axially in the interior of the operative pliers unit 5. The sliding that produces a moving away from the pliers 45 is obtained by means of a cranked lever 63 (see FIGS. 5, 6, and 7), one arm of which is integral with the extremity of the rod 62; the sliding in the opposite direction is obtained by means of an axial return spring 64. The cranked lever 63 has its fulcrum on a pin 65 which is supported by a support 66 integral with the pincer group, and which cooperates with its other arm with a lever 67. Lever 67, through a pin 68 fixed to the frame of the machine, is integrally connected to another lever 69 which is moved by cam 70 carried by the shaft 61. Lever 67 is also connected by a tie rod 71 (see FIG. 3) to a lever 72, the fulcrum of which is the same pin 42*a* of the rocker arm 42 cooperating with the cam 35*g* carried by the shaft 15. The lever 72, seen in front view in FIG. 5, is instead covered by the rocker arm 42 in FIG. 3. The shaft 15, according to a predetermined program, will perform for each operative cycle of station 1, two successive rotations of 180° each, at the beginning and at the end of said cycle at the moment that the chain is delivered and at that when it is taken up. In particular, the first rotation of the shaft 15, which, according to said program, takes place as soon as the take-up unit 14, having arrived at the limit stop f1 of the slide 13, is in position to cooperate with the extremities of the rocker arms 37, 38, 39, 42, and 72, causes in succession:the axial movement of the hollow shaft 22 upwards, i.e. toward the working plane L of the station 1; then the angular movement of the entire unit toward the feed and spiral formation unit 2 until the link of the chain held by pincer 27 is engaged with the first turn of the spiral, and; lastly, the axial sliding of the tappet 28 which, when its wedge-shaped end is disengaged from the projections 27*a* of the pliers 27, relieves spring 29, thus causing the opening of the pliers 27 and the release of the link held by them. After this phase the take-up unit 14 returns, through the effect of the springs 32, 33, and 44, to its rest position placed at a lower level with respect to the working plane L of station 1. The take-up unit 14 remains in this position until the end of the operative cycle imposed by the above-mentioned program for station 1, when a second 180° rotation of the shaft 15 will lift the unit again, bring the pliers 27 close to the operative pliers 45 of the pliers unit 5 with consequent take-up of the link held by it and simultaneous opening of the pliers 45 which in this manner releases the chain being formed from the station 1. At this point the take-up unit 14 returns again to its rest position, while motor 12 is activated to cause the rotation of the worm screw 10 and the consequent movement of the slide 13 toward the station 1' of the machine, where the operative sequence heretofore described will be repeated according to the preset program, which is a function of the characteristics of the chain to be manufactured. Note that when pliers 45 open , controlled by levers 71, 67, and 63, lever 69 is also passively moved, because it is integral with lever 67 through pin 68; the opposite occurs when, during the production phase, shaft 61 is in movement and shaft 15 is idle, the operation of pliers 45 being controlled by lever 69.

In order to facilitate the chain C take-up operation carried out by pliers 27, (i.e. the engagement of the last link, formed in one station, with the first turn of the wire spiral that is being formed in the other station), the machine according to the invention can be equipped with a device for advancing the start-up of the wire-like material feed and spiral formation units 2 and 2', in such a way that, when pliers 27 engage the spiral turn with the last link of chain C, said turn is already partially rotated and therefore moved forward along its axis. Referring to FIG. 5, said device (which each station can be equipped with) comprises a grooved cam 74 and a bushing 75, both carried to the end of shaft 15 (16). On bushing 75, there is slidably mounted a positive clutch member 76, actuated by a lever 77 carrying two rollers 78 and 79 respectively engaged within grooved cam 74 and clutch member 76. A toothed flange 81 is keyed on an auxiliary shaft 80, coaxial and in alignment with shaft 15 and pivotally supported by the machine frame; toothed flange 81 faces clutch member 76 for engaging with it thus causing auxiliary shaft 80 to rotate. By means of a pinion 82, carried by shaft 80, and a chain an angular displacement is transmitted to shaft 53, which drives the spiral formation unit 2 of station 1. Rotation of shaft 61, connected to shaft 53 by pinion 73, has to be avoided in this phase. To this end the above described device provides for a temporary disengagement of pinion 73 from shaft 61 when shafts 15 and 80 are engaged together. A lever 77 is connected by means of a tie-rod 83 to another lever 84 having an end 85 pivotally connected to the machine frame, the other end (see FIG. 8) carrying a slide 85 engaged with a clutch 86 slidably mounted on a bushing 87 keyed on shaft 61. During production phase said clutch is engaged with pinion 73 thus enabling transmission of rotation between shafts 53 and 61. During the advance phase, created by the above described device, a displacement of lever 84 causes clutch 86 to be disengaged from a toothed hub 88 carrying pinion 73, so that the latter is free to rotate on needle bearing 89 without transmitting the motion to shaft 61.

If the advance device described above is mounted on the machine according to the invention, it is necessary that motors 7 and 7' for driving stations 1 and 1' be connected to shaft 61 instead of shaft 53 as previously described and, in particular, as shown in FIG. 1, in order to allow a phase recovery between the two shafts for the normal conditions of the station operating cycle.

Mounting the above described device on a machine according to the invention, even not essential for a good operation of said machine, is nevertheless advisable, because it facilitates not only the chain take-up operation, but also reduces the noise of the machine and makes easier and careful the syncronisms adjustment and the initial setup.

It is clear that in the machine according to the present invention there will be limit stop microswitches, adjustments for the contacts between the various cooperating organs and the strokes of the various slides, and any and all other devices necessary for coordinating and synchronizing the various operative parts of the machine. None of these componets are described or illustrated, as they are well-known to persons skilled in the art. In particular, for the realization of the intermittent and alternating rotations of the camshafts of the stations 1 and 1', of the shafts 15 and 16, and of the worm screw 10, electric motors of the type known as permanent magnet motors are provided; this type of motor assures instantanous starts, stops, and reversals: these functions are necessary for good machine operation. Moreover, they permit a timed control of the acceleration and deceleration times, in order to efficiently oppose the inertia of the moving components.

Even if the preferred embodiment of the present invention provides for a machine with only two formation stations, and that is a machine which is capable of making chains formed of no more than two different types of links, even if linked in any desired sequence, it is clear that machines with three or more formation stations can be constructed; in this case, aside from the necessity for adding two further motors for each formation station added, the only difference with respect to the machine hereinbefore described is the fact that the intermediate station or stations will be structurally modified so as not to create obstacles to the transit of the take-up unit 14.

The machine according to the present invention can, finally, be planned for the production of twisted-type chains, in which one link is engaged to the two preceding; that is, the "double curb" chain. To this end it is necessary to add a needle linking unit, of the known type, to each station. As we have already said, in this case the needle, at the beginning of the operative cycle of each station, must execute a preliminary stroke of an amplitude different from those of the production phase; these are controlled in the traditional manner. The control of said stroke is by means of a cam and a relative lever carried by the same shaft of the cams which actuate the take-up unit 14, and in particular by shafts 15 and 16 for the stations 1 and 1' of the machine, hereinbefore described.

Further variations and modifications may be made on the machine for the production of alternate-link chains as hereinbefore described and illustrated in the accompanying drawings without departing from the scope of the present invention as defined in the appended claims.

What we claim is:

1. A machine for the manufacture of ornamental chains made up of links of different forms and/or sizes arranged according to any programmable sequence, comprising:

at least two independent stations for the formation of the chain (1, 1'), each station including a unit for forming the links (2, 2'; 3, 3') from wire, and a unit for forming the chain itself (4, 4'; 5, 5') from said links, each of said stations being provided with its own driving means and operating according to alternate working cycles of variable length, in accordance with a preset, variable program;

mobile means for intermittently sliding between said stations, said sliding movement being concomitant with the end of one of said cycles in one station and with the beginning of another of said cycles in another station, according to said program;

a take-up unit (14) carrying pliers 27 integral with said mobile sliding means (13) for taking-up, transferring and delivering the chain being manufactured from one formation station to another, said take-up unit being pivotably supported, by said mobile sliding means, about an axis parallel to the direction of said sliding movement;

guide means (28) for said chain being produced, integral with said take-up unit (14);

drive means (37, 38, 39, 43, 67, 72), for said take-up unit, independent of said drive means for each of said stations and activated at the end and at the beginning of each of said work cycles within said stations according to said program, for controlling the opening and the closure of said pliers (27) in the phase in which they pick up the last link of the chain being formed and during the phase of delivery to the various stations, said take-up unit drive means providing for them movements of approach and removal in the direction of a station, in coincidence with said phases, said take-up unit drive means (67, 72) further controlling the release of said last link from the formation station (1, 1') at the end of its work cycle, simultaneously with the take-up of said link by the take-up unit (14).

2. Machine according to claim 1, wherein said take-up unit (14) is movable, parallel to the working plane (L) of said stations for the formation of the chain (1, 1'), between corresponding positions of cooperation with them in which said unit is substantially aligned with their working axis (X, Y), said driving means being adapted for controlling alternate, intermittent angular movements of said unit with respect to said axis, in coincidence with the phase of take-up of the link from one station and with the phase of delivery to the other.

3. Machine according to claim 2, wherein said take-up unit (14) comprises a base (19) pivotally supported by said mobile equipment (13) and a hollow shaft (22) integral with said base and axially slidable with respect to it, to one end of said shaft being pivotally connected two arms of pliers (27), elastically connected therebetween, a tappet (28) sliding within said hollow shaft being further provided having a wedge-shaped end (**28*a***) for cooperating with said pliers arms in order to control the opening and closure thereof.

4. Machine according to claim 3, wherein said tappet (28) is axially hollow in order to provide a conveyer guide for the part of the chain already formed.

5. Machine according to claim 1, wherein said driving means of the take-up unit (14) comprise, for each station of formation,cams (**35*a* to *g*) and rocker arms (37, 38, 39, 42) cooperating with said unit in correspondence to every travel end of said mobile equipment (13**) and connected to motor means activated, according to said above mentioned program, at the beginning and at the end of the work cycle in the station.

6. Machine according to claim 2, wherein said driving means of the take-up unit comprise, for each station, a shaft (15, 16) with cams (**35*a* to *g*) which cooperate with the respective rocker arms (37, 38, 39, 42) to control the axial sliding of said hollow shaft (22) with respect to said base (19), the axial movement of said tappet (28) within said hollow shaft (22), and the angular movement of the take-up unit (14) with respect to said working axis (X, Y), elastic means (32, 33, 34) being provided for controlling opposite sliding movements of said hollow shaft and said tappet and an opposing angular movement of said unit, said camshaft (15, 16) making two successive 180° rotations in the same direction, the first in correspondence to the beginning, the second to the end of each work cycle (1, 1') of the station in which said take-up unit (14**) is operating.

7. Machine according to claim 6, wherein said camshaft (15, 16) is also provided with a cam (**35*g*) for the control of the opening of operative pliers (45) being part of the station of formation (1, 1'), for holding the last link formed therein at the end of the work cycle in the station, the opening of said operative pliers (45) being simultaneous to the closure of pliers (27) of said take-up unit (14) on the last link of the chain, which can thus be removed from said station (1, 1'**).

8. Machine according to claim 7, wherein there is a lever (63) for controlling the opening of said operative pliers (45) actuated during the work cycle of the station (1, 1') by the driving means (67, 69) of the station itself and by the drive means (67, 72) of the take-up unit (14) at the beginning and at the end of said cycle.

9. Machine according to claim 1, wherein said mobile equipment (13) comprises a slide (13) slidably mounted on parallel guides(9) and connected to alternative drive means (12).

10. Machine according to claim 9, wherein said alternative drive means comprise motor means (12) connected to a worm screw (10) parallel to said guides (9) slidably supporting said slide (13), said worm screw (10) being rotated in accordance with said program at the end of each of said work cycles of the stations for the formation of the chain (1, 1').

11. Machine according to claim 1, wherein the pliers (27) of said take-up unit (14) are substantially in the form of a beak laterally and obliquely protruding with respect to its working axis (X, Y).

12. Machine according to claim 1, wherein there is provided for a temporary connection between said camshaft (15, 16) and said station driving means for advancing the start-up of said link formation unit (2, 2') from wire-like material of a station (1, 1') during the take-up phase of the last link formed in another station.

13. Machine according to claim 12, wherein said temporary connection comprises a clutch advance device for transmitting the motion from said camshaft (15, 16) to said station driving means for the link formation unit (2, 2'), said device also actuating a temporary interruption of motion transmission to the chain formation unit (4, 4'; 5, 5') of the same station.

14. Machine according to claim 13, wherein said clutch advance device comprises a cam (74) integral with said camshaft (15, 16), a lever (77) moved by the active profile of said cam (74) and clutch members (76, 81) respectively integral with said camshaft (15, 16) and an auxiliary shaft (80) for the motion transmission to said station driving means for the link formation unit (2, 2'), said lever (77) being responsive for the mutual engagement and disengagement of said clutch members (76, 81) and for the temporary interruption of motion transmission between camshaft (53) driving the link formation unit and camshaft (61) driving the chain formation unit.

* * * * *

UNITED STATES PATENT AND TRADEMARK OFFICE

CERTIFICATE OF CORRECTION

PATENT NO. : 4,548,031

DATED : October 22, 1985

INVENTOR(S) : Massimo BUCEFARI and Michele LAZZARINI

It is certified that error appears in the above-identified patent and that said Letters Patent is hereby corrected as shown below:

On the title page, Item /75/ should read:

[75] Inventors: Massimo Bucefari, Michele Lazzarini, both of Arezzo, Italy

Item /19/ should read: -- Bucefari et al. --.

Signed and Sealed this

*Nineteenth* Day of *August 1986*

[SEAL]

*Attest:*

DONALD J. QUIGG

*Attesting Officer*

*Commissioner of Patents and Trademarks*